United States Patent [19]

Allwes

[11] Patent Number: 4,596,151

[45] Date of Patent: Jun. 24, 1986

[54] BIAXIAL PRESSURE SENSOR

[75] Inventor: Richard A. Allwes, Pittsburgh, Pa.

[73] Assignee: The United States of America as represented by the Secretary of the Interior, Washington, D.C.

[21] Appl. No.: 756,535

[22] Filed: Jul. 19, 1985

[51] Int. Cl.[4] ..... E21B 49/00

[52] U.S. Cl. ..... 73/784

[58] Field of Search ..... 73/84, 784, 825, 151

[56] References Cited

U.S. PATENT DOCUMENTS 3,364,737 1/1968 Comes ..... 73/84 X 3,499,320 3/1970 Fox et al. ..... 73/84 X

*Primary Examiner*—Jerry W. Myracle

*Attorney, Agent, or Firm*—Thomas Zack

[57] ABSTRACT

A pressure sensor (10) is useful for monitoring stress changes and stress fields in a medium (12) having a borehole (14) defined therein. The pressure sensor uses piston assemblies (22, 24, 26) to transmit pressure changes to gages (84) via a fluid in a fluid line (78). The piston assemblies can be spaced apart angularly and longitudinally of the borehole to monitor a plurality of locations (16, 18 and 20), and are angularly movable with respect to each other.

5 Claims, 4 Drawing Figures

BIAXIAL PRESSURE SENSOR

TECHNICAL FIELD

The present invention relates in general to measuring and sensing devices, and more particularly to measuring and sensing devices for use in rock mechanics.

BACKGROUND ART

In the field of rock mechanics, the stress characteristics of a medium are often monitored. This is often done by placing a pressure sensor in a borehole defined in the medium. As many data points as possible should be provided to produce an accurate, precise stress reading, and this requirement creates a need for a provision of as many sensors in the borehole as is possible. Furthermore, to be most accurate and precise, a stress picture at each data point should also be provided thereby producing a requirement of versatility for the sensors. Therefore, the sensors must not only be versatile, they must be small and sensitive enough so a great may data points can be measured in the borehole.

Furthermore, since the sensors may be used in a harsh environment, they must also be rugged. Requirements for rugged and durable construction may be contrary to requirements associated with small, sensitive and versatile sensors. Thus, accurate and precise measurement of stress changes in a medium surrounding a borehole in the mining art may be a difficult goal to achieve.

In the past, stress changes have been measured by several types of devices. One type of these prior art devices is exemplified by a coal cell which measures stress changes in only one direction. While such devices may be useful for many purposes, accurate and precise stress change monitoring requires measurement in a plurality of directions at a plurality of locations within the borehole. Therefore, sensors which measure stress changes in but one axial direction are not entirely adequate for such uses.

Another type of sensor used to measure stress changes in a medium surrounding a borehole uses tensioned wires. An example of this type of device is disclosed in U.S. Pat. No. 4,159,641. Pressure changes in the medium changes the tension in the wires, which is then translated into stress changes. While such devices can measure stress changes at a plurality of positions, these devices cannot easily define a stress field or gradient as only a limited number of instruments can be practically placed in a single borehold. Furthermore, such devices may be quite sensitive to temperature or humidity variations or corrosion, and may not be as rugged and durable as is desirable.

Furthermore, many devices may not be usable in all mediums due to instabilities in that medium. For example, devices which use the modulus of elasticity of the medium as the factor monitored would not be usable if the medium is salt because salt creeps at very low pressures (for example, 145 psi) and thus does not have a modulus of elasticity.

DISCLOSURE OF THE INVENTION

It is a main object of the present invention to provide a novel and improved pressure sensor for use in the mining art which is rugged and durable, yet can accurately and precisely measure stress changes in a medium surrounding a borehole.

It is another object of the present invention to provide a novel and improved pressure sensor for use in the mining art which can provide a plurality of data points at a plurality of angularly and axially spaced positions in the borehole.

It is another object of the present invention to provide a novel and improved pressure sensor for use in the mining art which can accurately and precisely measure changes in a biaxial stress field.

It is a specific object of the present invention to provide a novel and improved pressure sensor for use in the mining art which is suitable for measuring a biaxial stress field in an anomalous zone of a salt dome.

It is another object of the present invention to provide a novel and improved pressure sensor for measuring a stress gradient in a medium defining a borehole.

It is another object of the present invention to allow a stress state of a borehole to be measured at three or more separate locations. The number of locations can be increased for large diameter boreholes.

These and other objects are accomplished by the means and method embodying the present invention. The means and method of the invention permit biaxial stress changes to be measured in a host of media via a borehole. The biaxial sensor comprises a plurality of hydraulic cylinders angularly offset from each other. Each hydraulic cylinder assembly is composed of a platen, piston, stop plate, and cylinder. The platen is flat on the bottom and the top is conformed to match the radius of the borehole. The piston is attached to the platen and pushes the platen against the borehole wall when activated. The stop plate limits the stroke of the piston and prevents the piston from coming out of the cylinder. The cylinder houses the piston and hydraulic fluid. The cylinder is also rounded to conform to the shape of the borehole. The sensor is "set" in the borehole by pumping hydraulic fluid into the separate hydraulic cylinders. The platens are, in turn, pressed against the borehole walls. Any pressure changes occurring within the borehole will be detected by the hydraulic cylinders.

BEST MODE FOR CARRYING OUT THE INVENTION

Figure 1:
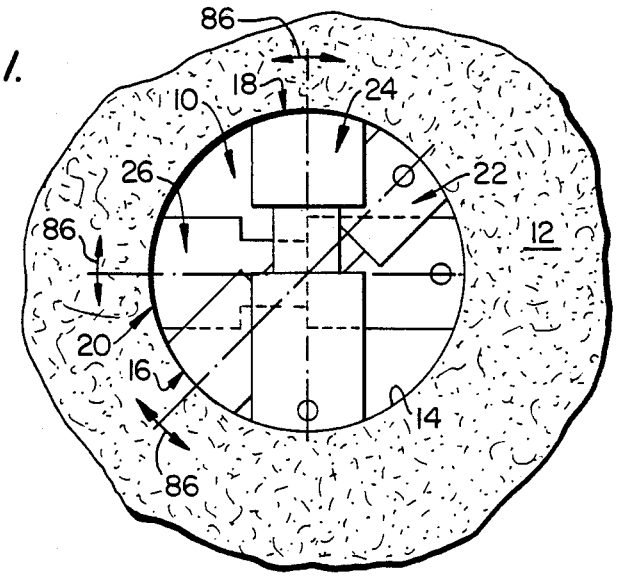
FIG. 1 is a top plan view of a borehole showing a pressure sensor in position to monitor stress changes in a medium surrounding a borehole with cylinder assemblies spaced apart 45 degrees from each other.

Shown in FIG. 1 is a pressure sensor 10 for measuring stress changes in a host medium 12, such as salt, or the like, in which a borehole 14 is defined. The pressure sensor is capable of monitoring the medium at a plurality of locations 16, 18 and 20 which are spaced apart axially of the borehole and spaced apart angularly with respect to each other.

Figure 2:
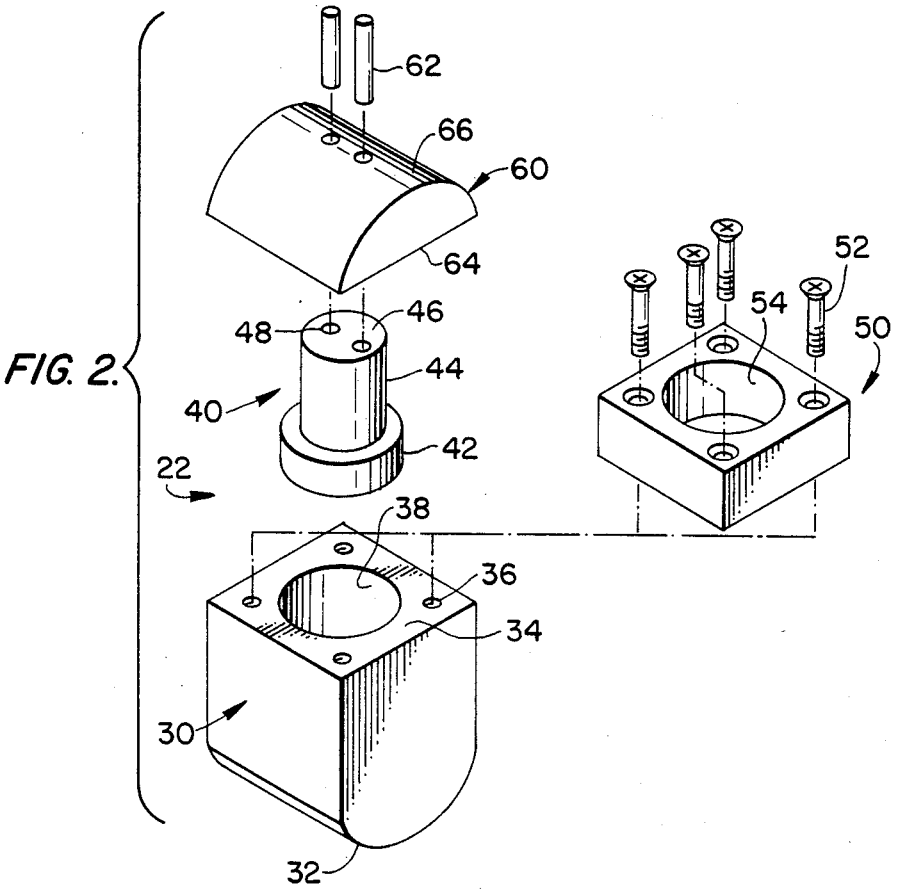
FIG. 2 is an exploded perspective of a pressure sensing cylinder arrangement.

The pressure sensor utilizes hydraulic piston-cylinder assemblies 22, 24 and 26 to detect stress changes at locations 16, 18 and 20 respectively. The assemblies are identical to each other and assembly 22 is shown in FIG. 2. The assembly includes a cylinder housing 30 which has one arcuate end 32 shaped to snugly engage the medium from within the borehole, and one planar end 34 which is located inwardly of the borehole when the sensor is in the FIG. 1 position. A plurality of bolt-receiving holes 36 are defined in the housing in planar end 34. These holes may be internally threaded if required. A piston receiving bore 38 is defined in the housing to extend from end 34 toward end 32.

A piston 40 is movably mounted in the piston receiving bore to move toward and away from end 34. The piston includes a head 42 and an outer surface 44 with an abutting face 46 on the end thereof remote from the head. A bolt receiving holes 48 are defined in the face 46. Bore 38 is sized to accommodate the piston head 42.

A stop plate 50 is mounted on the cylinder housing end 34 by a plurality of bolts 52. The stop plate includes a bore 54 sized so the piston outer surface 44 slidably engages the top plate adjacent the bore 54. The bore 54 is smaller than the piston head so the piston is retained in the bore 38 during operation of the pressure sensor.

A platen 60 is mounted on the piston abutting face by bolts 62, or the like. The platen 60 includes a planar face 64 contacting the piston abutting face, and an arcuate end 66 which abuts the host medium adjacent the borehole when the pressure sensor is in the operative configuration. The arcuate shape of end 66 permits snug, secure engagement of the cylinder assembly in the borehole.

Figure 3:
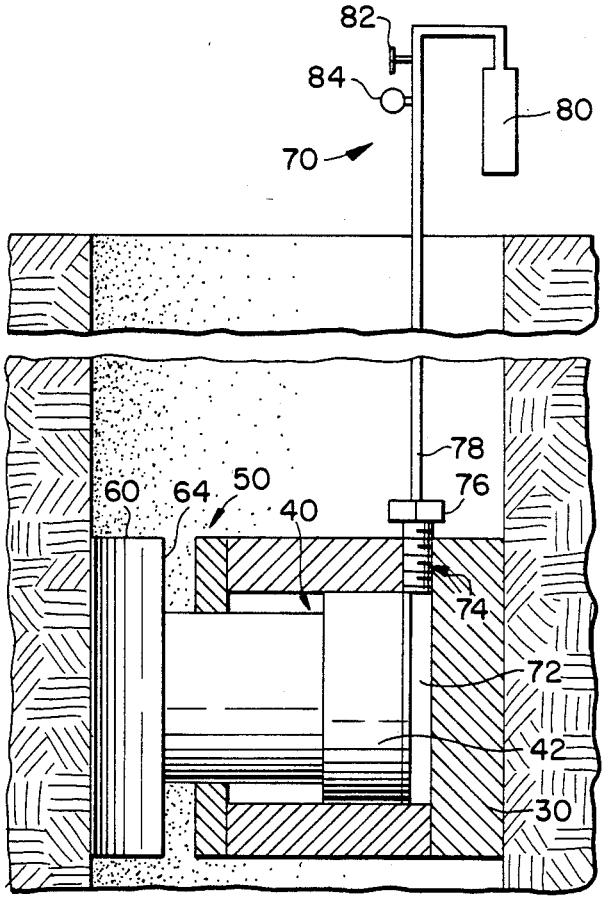
FIG. 3 is a schematic of the pressure sensing cylinder arrangement in position in the borehole and showing the cylinder operatively connected with monitoring equipment.

As best shown in FIG. 3, the cylinder assembly is connected to monitoring equipment 70 located outside the borehole. The cylinder housing has a fluid chamber 72 defined therein between piston head 42 and the cylinder housing. An inlet valve 74 is mounted on the housing and a fitting 76 connects the inlet valve to hydraulic fluid line 78. The fluid line extends from the inlet valve to a fluid pump 80 located outside the borehole. A valve 82 located in the fluid line can be used to control pressure within that line.

A pressure gage 84 measures and indicates fluid pressure within the fluid line. Preferably, hydraulic fluid is used in the cylinder assembly, and thus the fittings and the line itself should be compatible with such fluid and capable of handling the pressures associated with the assembly.

In operation, the pressure sensor is positioned in the borehole with the piston-cylinder assemblies spaced apart axially of the borehole and angularly with respect to each other. The fluid in the chambers 72 is pressurized to the desired level by means of the pump and values. The fluid has a known bulk modulus of elasticity and known properties so the pressures can be accurately set. Stress changes in the hot medium will be manifested in pressure changes of the fluid in chambers 72 as a result of movement of the pistons. Such pressure changes will be monitored via gages 84 and translated into stress changes via appropriate equipment.

Figure 2A:
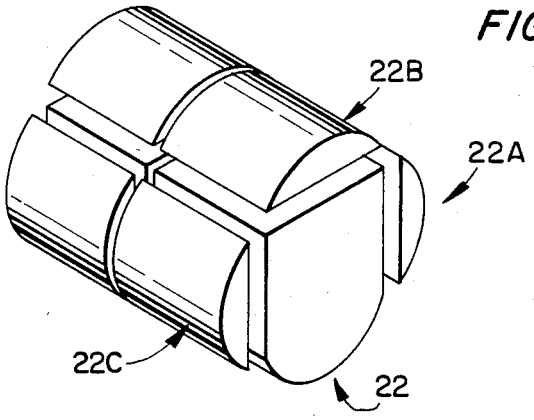
FIG. 2A is a perspective showing three angular orientations for a cylinder assembly.

As indicated by arrows 86 in FIG. 1, and by the several orientations indicated in FIG. 2A, as 22A, 22B and 22C each cylinder assembly can be rotated about the longitudinal centerline of the borehole with respect to the other cylinder assemblies. This rotation permits measurement of a stress field or gradient at any angular location of the borehole. Thus, for example, both assemblies 22 and 24 can be rotated about the longitudinal axis of the borehole from position angularly spaced with respect to each other and with respect to assembly 26 to be aligned with, but longitudinally spaced from, the assembly 26. In such a configuration, measurement and monitoring of a stress field located along a single line extending longitudinally of the borehole is possible so that if the stress varies, a gradient or field can be mapped. All of the assemblies can be rotated in this manner to monitor stress fields and gradients at various angular locations in the borehole.

INDUSTRIAL APPLICABILITY

The pressure sensor and method described herein is most useful in measuring biaxial stresses in an anomalous zone of a salt dome, as well as in coal or other host mediums. The size and weight of the piston cylinder assemblies permits the sensor to make a multiplicity of measurements. These assemblies can be used in boreholes two inches or greater in diameter, and adjacent assemblies are preferably angularly spaced apart by 45 degrees; however, other angular spacing can be used without departing from the scope of the present disclosure. Preferably, the hydraulic line 78 includes copper refrigeration tubing, but other materials and types of tubing can be used to transmit hydraulic fluid from the biaxial pressure sensors to the gages and valves. The gages can be calibrated to present stress data, or pressure data as required, and can be any suitable type of measuring and/or recording device. Any suitable means can be used to permit rotation of the piston-cylinder assemblies. For example, washers, lock-nuts and other suitable couplings can be placed on the line 78 and on any support means on which the piston-cylinder assemblies might be mounted. Other means can also be used as suitable without departing from the scope of this disclosure.

I claim:

1. A sensor for measuring stresses in a medium defining a borehole comprising:

sensing means for sensing pressure changes of the medium at a plurality of axially spaced apart locations in the borehole; and means for permitting rotating said sensing means with respect to each other for sensing pressure changes of the medium at a plurality of angularly spaced apart positions at each location.

2. A sensor for measuring stress changes occurring in a medium surrounding a borehole, comprising:

a plurality of pistons for contacting the medium at a plurality of angularly spaced-apart locations and a piston activating means associated with each of the pistons, said piston activating means for each of the pistons including:

a chamber defining means associated with said piston;

hydraulic fluid means in said chamber defining means for forcing said piston into contact with the medium;

pressurizing means connected to said hydraulic fluid for establishing a known pressure on said hydraulic fluid; and said activating means also having a pressure sensing means for sensing pressure changes of hydraulic fluid located in said chamber for correlating said hydraulic fluid pressure changes to stress changes which may occur in the medium surrounding the borehole; and means for permitting rotation of each of said pistons to apply pressure to the borehole defining medium at a plurality of angularly spaced positions at each axially spaced location for defining variations in a stress field at each location.

3. A sensor for measuring stress changes of a medium defining a borehole comprising:

means for sensing pressure changes in the medium along a plurality of different axes, said means including sensing gages, a fluid for transmitting pressure changes to said sensing gages, and piston means including a plurality of pistons spaced apart angularly within the borehold and axially of the borehole, said pistons engaging the medium in the borehold and said fluid transmitting pressure changes of the medium to said fluid and thereby to said sensing gages to provide an indication of stress changes in the medium; and means for permitting rotation of each of the pistons with respect to the other pistons for defining a stress field in the medium.

4. A sensor for measuring external stress changes occurring in a medium defining a borehole, comprising:

at least three pistons for contacting the medium at at least three different angularly spaced-apart locations in the medium;

separate piston activating means for each of said at least three pistons for separately applying a pressurized fluid to each piston to mount it to the medium; and a separate pressure sensing means for sensing changes to each of the pistons when mounted in the borehole from the medium.

5. A method for detecting stress changes occurring in the medium defining a borehole comprising the steps of:

(a) applying a known amount of pressure to each of three movable pistons to mount each of the pistons at three different angularly spaced locations on the medium;

(b) during a time interval monitoring and noting the initial pressure and any pressure changes for each of the pistons mounted in step (a); and (c) translating the pressure changes of step (b) into stress changes occurring in the medium defining the borehole.

* * * * *